US008959976B2

(12) United States Patent
Cha

(10) Patent No.: US 8,959,976 B2
(45) Date of Patent: Feb. 24, 2015

(54) APPARATUS FOR MANUFACTURING A METAL PLATE FOR A DUCT, INCLUDING MESH-TYPE BEADS

(75) Inventor: Kyu-seok Cha, Hwaseong-shi (KR)

(73) Assignee: Jinwoong Technology Co., Ltd. (KR)

( * ) Notice: Subject to any disclaimer, the term of this patent is extended or adjusted under 35 U.S.C. 154(b) by 432 days.

(21) Appl. No.: 13/512,932

(22) PCT Filed: Dec. 1, 2010

(86) PCT No.: PCT/KR2010/008553
§ 371 (c)(1),
(2), (4) Date: May 31, 2012

(87) PCT Pub. No.: WO2011/068353
PCT Pub. Date: Jun. 9, 2011

(65) Prior Publication Data

US 2012/0234065 A1 Sep. 20, 2012

(30) Foreign Application Priority Data

Dec. 1, 2009 (KR) ..... 10-2009-0117619

(51) Int. Cl.
*B21D 13/04* (2006.01)
*B21D 17/04* (2006.01)
*F24F 13/02* (2006.01)

(52) U.S. Cl.
CPC ..... *B21D 17/04* (2013.01); *F24F 13/0245* (2013.01); *B21D 13/04* (2013.01)
USPC ..... 72/379.6

(58) Field of Classification Search
CPC ..... B21D 13/04; B21D 17/04
USPC ..... 72/252.5, 379.6
See application file for complete search history.

(56) References Cited

U.S. PATENT DOCUMENTS 3,306,188 A * 2/1967 Young et al. ..... 101/23
4,020,666 A * 5/1977 Beymer ..... 72/177
4,732,082 A * 3/1988 Ireton ..... 101/23

FOREIGN PATENT DOCUMENTS

JP 7000205 1/1995
KR 200219928 4/2001
KR 1020020030176 4/2002

OTHER PUBLICATIONS

International Search Report—PCT/KR2010/008553 dated Jun. 28, 2011.

* cited by examiner

*Primary Examiner* — Teresa M Ekiert
(74) *Attorney, Agent, or Firm* — Cantor Colburn LLP

(57) ABSTRACT

The present invention relates to an apparatus for manufacturing a metal plate for a duct. The apparatus includes a frame (F) constituted by connecting metal pieces in a form of a box; roll stands (F2) vertically installed on a top surface of the frame (F); upper and lower bead processing rolls (2 and 4) provided at both ends thereof with shafts (S1 and S2) and formed on outer surfaces thereof with embossments and intaglios; a feeding part (100) including idle rollers (110) to stably feed metal plates from a rear of the upper and lower bead processing rolls (2 and 4); first and second gears (S1-1 and S2-2) coupled to the shafts (S1 and S2) of the upper and lower bead processing rolls (2 and 4); a pulley (76) coupled to the second gear (S2-2); and a driving unit (7) including a driving motor (72).

8 Claims, 8 Drawing Sheets

APPARATUS FOR MANUFACTURING A METAL PLATE FOR A DUCT, INCLUDING MESH-TYPE BEADS

TECHNICAL FIELD

The present invention relates to an apparatus for manufacturing a metal plate used for manufacturing a duct. More particularly, the present invention relates to an apparatus for manufacturing a metal plate used for manufacturing a duct and formed with mesh-type beads, in which the mesh-type beads having grid patterns with regular concavo-convex shapes are formed on a surface of the metal plate for the duct to increase strength of the duct, thereby reducing the manufacturing cost for the duct by reducing the thickness of the duct and improving the external appearance of the duct.

BACKGROUND ART

With the development of constructional technologies, modern buildings are getting higher for effective utilization of land. In particular, high-storied business buildings are mainly steel-framed, in which sealed windows are employed, and even if openable windows are employed, the size of the openable windows tends to be small for the purpose of saving the air-conditioning cost of the buildings.

Therefore, in the case of the high-storied business buildings, the artificial air conditioning system is generally employed rather than the natural air conditioning system. The role of a duct serving as an air path for circulating the conditioning air has become more important in the air conditioning system.

According to the related art, the duct, which is essential to the modern buildings, is generally manufactured by bending a galvanized steel sheet in a rectangular shape. In order to increase the strength of the duct, the steel sheet has the thick thickness, so the manufacturing cost for the duct may be increased. In addition, since the weight of the duct is increased, the strength of the buildings must be increased, so the construction cost for the buildings may be increased due to the increase of the strength of the duct.

Further, as the buildings have been built with the large-scale and high stories, the size of the duct must be enlarged. Thus, in order to reinforce the strength of the duct, the thickness of the metal plate for the duct must be increased. However, there are limitations to improve the strength of the duct through the increase in thickness, so the duct is necessarily decreased in length and increased in number as well as reinforcing materials must be used in a great quantity. As a result, the weight of the duct is increased and transportation and construction work for the duct is complicated, so that the overall cost for installing the duct may be increased.

In addition, different from the air conditioning duct, which is concealed by interior and exterior materials of the buildings, the industrial duct is exposed to the outside, so the industrial duct represents the problem in terms of the external appearance as well as the strength.

That is, the metal plate generally used for manufacturing the conventional duct is a simple flat plate or linear beads are regularly formed on the metal plate in the direction vertical to the length direction of the duct in order to improve the strength of the duct. Thus, the aesthetic appearance of the duct may be poor after the duct has been installed.

In particular, the duct employing the flat plate may have a fatality that can hardly absorb vibration from earthquake or machinery.

In this regard, applicant of the present invention has filed an application entitled "an apparatus for manufacturing a metal plate having mesh-type beads for a duct" and this application has been registered as Korean Registered Patent No. 0394557. According to the above application, the metal plate is formed on a surface thereof with regularly intersecting beads so that the duct can be enhanced in strength and vibration applied to the duct can be absorbed at a certain degree by bending portions for forming the beads as well as a regular pattern formed on the surface can provide an effect of improving the external appearance of the duct.

FIG. 8 shows the apparatus disclosed in the above application.

As shown in FIG. 8, the apparatus includes a base frame 41 constituted by a rectangular base plate 41B for settling a driving motor M as a driving unit, four posts 41A respectively erected on four corners of the base plate 41B and an upper plate 41C connected to the upper ends of the posts 41A as an upper part of the base frame 41; a pair of roll stands 42 erected on both ends of the upper plate 41C of the base frame 41; a pair of upper and lower pinch rolls 43 inserted into roll chokes RC by bearings assembled to choke-assembling recesses H at the both roll stands 42; a pair of bead processing rolls 44 assembled to the both roll stands 42 in the same manner parallel with the pinch rolls 43 and having bead-shaped embossments and intaglios in the surface for forming beads; and a power transmission unit constituted by sprockets MS, 43A and 44A respectively arranged at one ends of the rotary axis of the driving motor M, the pinch rolls 43 and the bead processing rolls 44 and a chain C for connecting the sprockets MS, 43A and 44A to drive the bead processing rolls 44 and pinch rolls 43.

The apparatus having the above structure operates as follows.

The sprocket MS provided at the rotary axis of the driving motor is connected to the sprocket 43A provided at one end of the lower pinch roll and the sprocket 44A provided at one end of the lower bead processing roll. Between the lower pinch roll sprocket 43A and the lower bead processing roll sprocket 44A, a tension sprocket TS is rotatably provided at an outer side of the one roll stand for imparting tension to the chain C and ensuring correct and stable power transmission.

Therefore, when the driving motor M is rotated, the lower pinch roll and the lower bead processing roll are rotated together.

In this case, the upper pinch roll is a non-driving roll which is rotated only if contacted with the lower pinch roll, and a sprocket 44C arranged at the other end of the upper bead processing roll is coupled to the sprocket 44B arranged at the other end of the lower bead processing roll so that the upper bead processing roll is driven together with the lower bead processing roll.

In other words, after the driven motor is operated as the interval of the upper and lower pinch rolls is adjusted at or under the thickness of the metal plate, to which the beads are supposed to be formed, the metal plate P is inserted into the roll byte of the pinch rolls and moved into the roll byte of the bead processing rolls 44 by the upper and lower pinch rolls 43 so that the beads are formed in the surface of the metal plate between the upper and lower bead processing rolls having the bead shaped embossments and intaglios to obtain a metal plate DP for the duct.

However, several problems have been found after using the apparatus of the above patent.

First, if the length of the upper and lower bead processing rolls is increased, the center portions of the upper and lower bead processing rolls may be sagged downward due to the weight, so that the formation of beads may be deteriorated.

Second, the metal plate, on which the beads are formed while the metal plate is passing through the upper and lower bead processing rolls, is subject to the density variation due to the formation of the beads, so that the metal plate is gradually bent upward and rolled if the length of the metal plate is increased.

Third, the interval between the upper and lower bead processing rolls must be adjusted according to the thickness of the metal plate. However, if there is an error exceeding the tolerance of the chain and the sprocket, that is, if the interval between the upper and lower bead processing rolls is widened more than the predetermined thickness, the power transmission system is not connected, causing the disable state. Thus, the selection for the thickness of the metal plate may be limited.

DISCLOSURE

Technical Problem

The present invention has been made to improve Korean Registered Patent No. 0394557 issued to the applicant of the present invention, and a first object of the present invention is to provide an apparatus for manufacturing a metal plate having mesh-type beads for a duct, which includes an auxiliary roller device to support upper and lower bead processing rolls such that the upper and lower bead processing rolls may not be sagged downward, thereby facilitating the formation of beads on the metal plate.

A second object of the present invention is to provide an apparatus for manufacturing a metal plate having mesh-type beads for a duct, which includes a pressing roller device for pressing the metal plate such that the metal plate is not gradually bent upward when the metal plate is drawn after the beads are formed on the metal plate.

A third object of the present invention is to provide an apparatus for manufacturing a metal plate having mesh-type beads for a duct, in which an articulated connection part is installed to shafts of the upper and lower bead processing rolls to facilitate the adjustment of a gap between the upper and lower bead processing rolls according to the thickness of the metal plate.

Technical Solution

In order to accomplish the above objects, the present invention provides an apparatus for manufacturing a metal plate having mesh-type beads for a duct. The apparatus includes a frame constituted by connecting metal pieces in a form of a box; roll stands vertically installed on a top surface of the frame while being spaced apart from each other by a predetermined interval; upper and lower bead processing rolls provided at both ends thereof with shafts coupled to the roll stands and formed on outer surfaces thereof with embossments and intaglios having shapes corresponding to shapes of the mesh-type beads; a feeding part including a plurality of idle rollers to stably feed metal plates from a rear of the upper and lower bead processing rolls; first and second gears coupled to the shafts of the upper and lower bead processing rolls; a pulley coupled to the second gear; and a driving unit including a driving motor connected to the pulley through a chain.

Advantageous Effect

According to the present invention, an auxiliary roller device is provided to support upper and lower bead processing rolls such that the upper and lower bead processing rolls may not be sagged, thereby facilitating the formation of beads on the metal plate. In addition, a pressing roller device is provided to press the metal plate such that the metal plate is not bent upward after the beads are formed on the metal plate. Further, an articulated connection part is installed to shafts of the upper and lower bead processing rolls to facilitate the adjustment of a gap between the upper and lower bead processing rolls according to the thickness of the metal plate.

BEST MODE

Mode for Invention

Hereinafter, exemplary embodiments of the present invention will be described in detail with reference to accompanying drawings.

A metal plate for a duct according to the present invention uses work-hardening features of metal in which the stiffness thereof increases due to hardening, bent portions are followed after the formation of beads to enhance deformation resistance against external forces acting in longitudinal directions of the bent portions as well as imparts a force for absorbing vibration acting in lateral directions of the bent portions so that the duct is enhanced in overall strength and ability of absorbing vibration.

Each of the beads formed over the entire surface of the metal plate has a predetermined width and direction while one group of the linear beads parallel in one direction and another group of linear beads parallel in another direction are mutually intersected to define a grid-shaped or mesh-shaped regular crossing pattern in the surface of the metal plate so that the metal plate for the duct has the same deformation resistance against external load and vibration in all directions rather than applied in one direction.

The beads on the surface of the metal plate for the duct of the present invention are obtained by passing a metal flat plate through a pair of cylindrical bead processing rolls of an apparatus of the present invention, in which the bead processing rolls have embossments and intaglios having the shape the same as that of the beads to be rotated in mutual engagement.

Hereinafter, exemplary embodiments of the present invention will be described in detail with reference to accompanying drawings.

Figure 1:
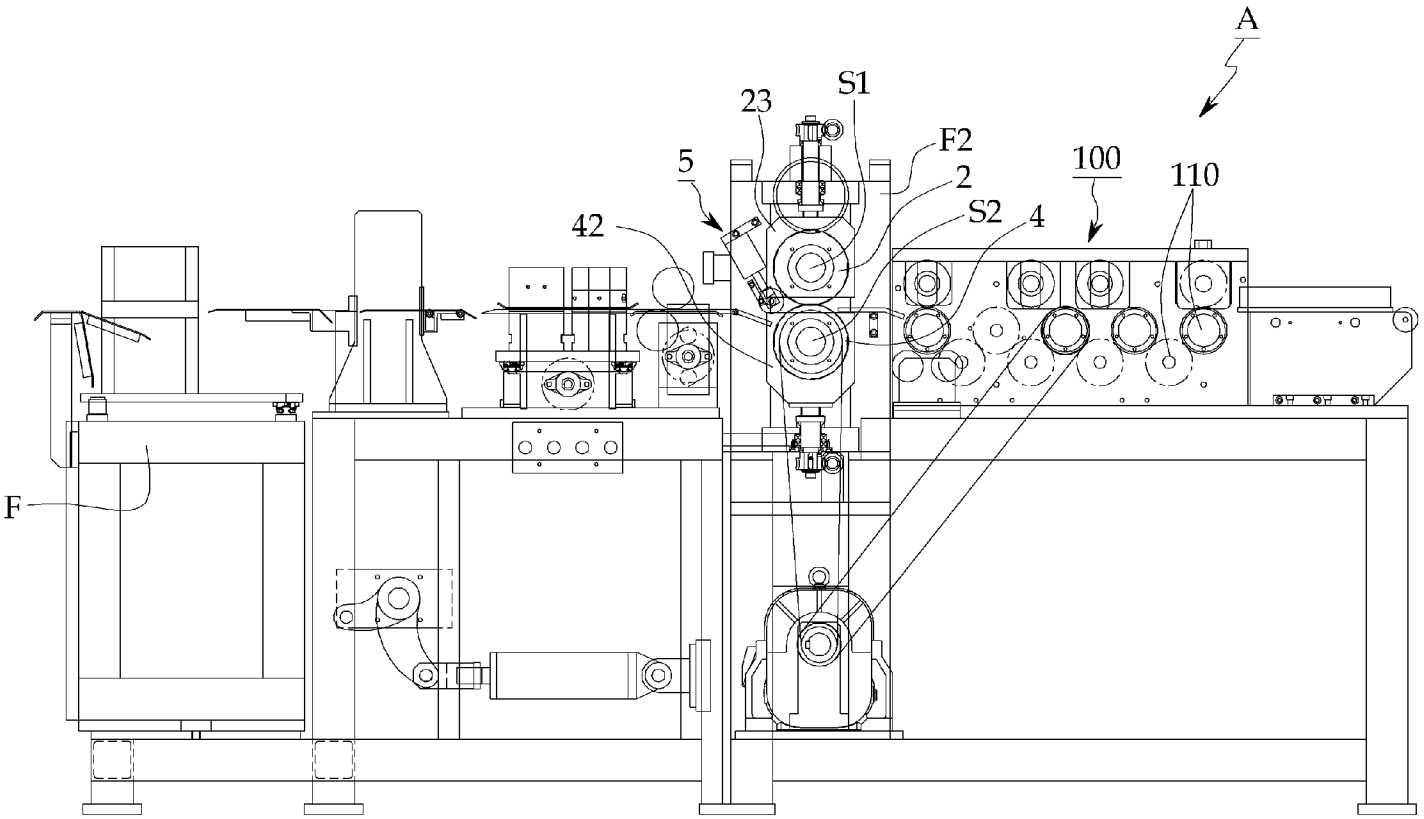
FIG. 1 is a front view showing an apparatus for manufacturing a metal plate having mesh-type beads for a duct according to the present invention.
Figure 2:
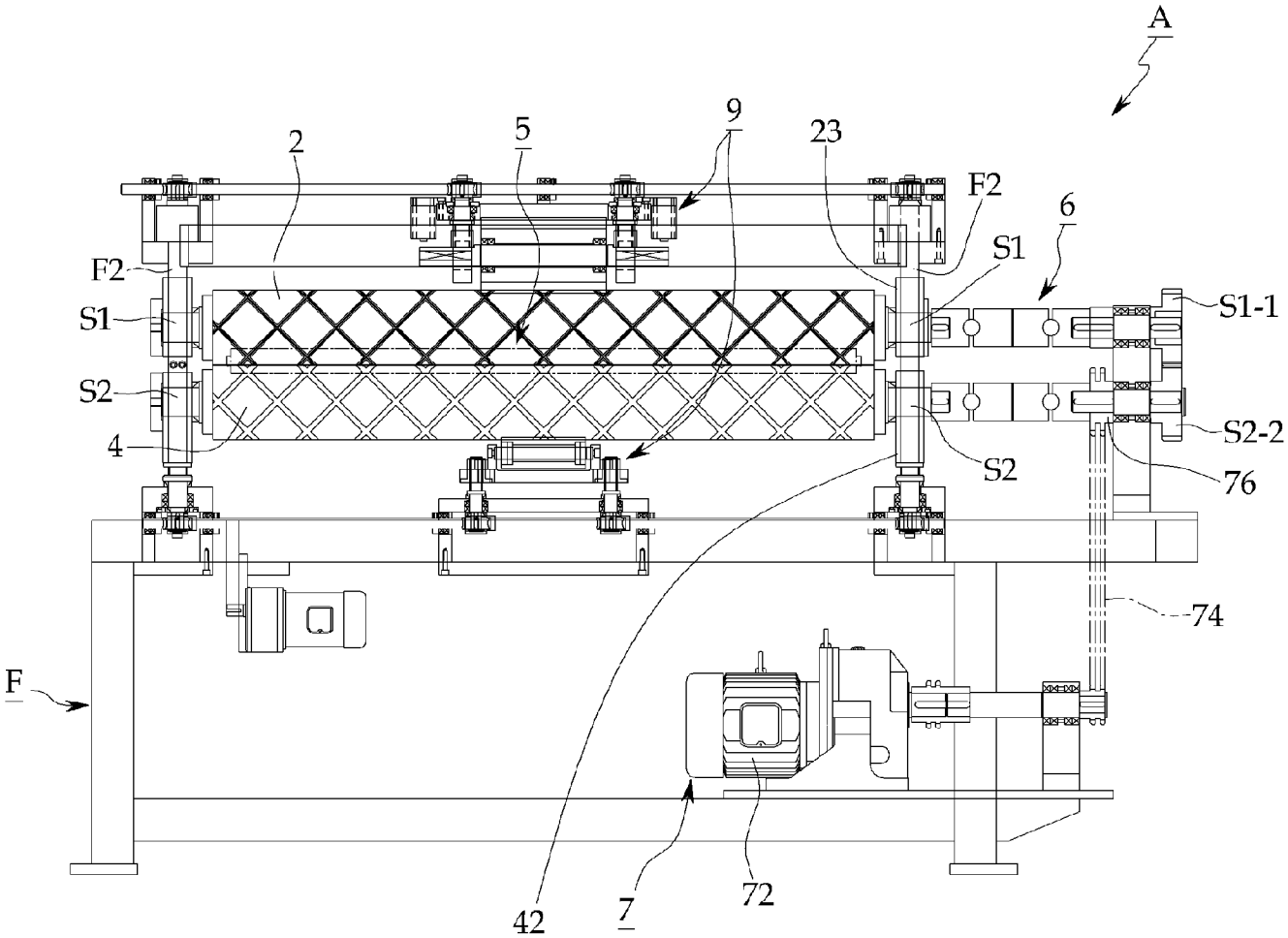
FIG. 2 is a left side view showing an apparatus for manufacturing a metal plate having mesh-type beads for a duct according to the present invention.

FIG. 1 is a front view showing an apparatus for manufacturing a metal plate having mesh-type beads for a duct according to the present invention, and FIG. 2 is a left side view showing the apparatus for manufacturing the metal plate having mesh-type beads for the duct according to the present invention.

As shown in FIGS. 1 and 2, the apparatus A for manufacturing the metal plate having mesh-type beads for the duct according to the present invention comprises:

a frame F constituted by connecting metal pieces in a form of a box;

roll stands F2 vertically installed on a top surface of the frame F while being spaced apart from each other by a predetermined interval;

upper and lower bead processing rolls 2 and 4 provided at both ends thereof with shafts S1 and S2 coupled to the roll stands F2 and formed on outer surfaces thereof with embossments and intaglios having shapes corresponding to shapes of the mesh-type beads;

a feeding part 100 including a plurality of idle rollers 110 to stably feed metal plates from a rear of the upper and lower bead processing rolls 2 and 4; first and second gears S1-1 and S2-2 coupled to the shafts S1 and S2 of the upper and lower bead processing rolls 2 and 4;

a pulley 76 coupled to the second gear S2-2; and a driving unit 7 including a driving motor 72 connected to the pulley 76 through a chain 74.

In addition, roll chokes 23 and 42 are coupled to the upper and lower bead processing rolls 2 and 4 and an auxiliary roller device 9 is provided at upper and lower portions of the upper and lower bead processing rolls 2 and 4 to prevent the upper and lower bead processing rolls 2 and 4 from being sagged downward.

Further, a pressing roller device 5 is installed at fronts of the upper and lower bead processing rolls 2 and 4.

In addition, an articulated connection part 6 including a plurality of articulated members is provided at the shafts S1 and S2 of the upper and lower bead processing rolls 2 and 4 to adjust an interval between the upper and lower bead processing rolls 2 and 4 by moving the upper and lower bead processing rolls 2 and 4 up and down.

Hereinafter, the structure of the above elements will be described in detail.

Figure 3:
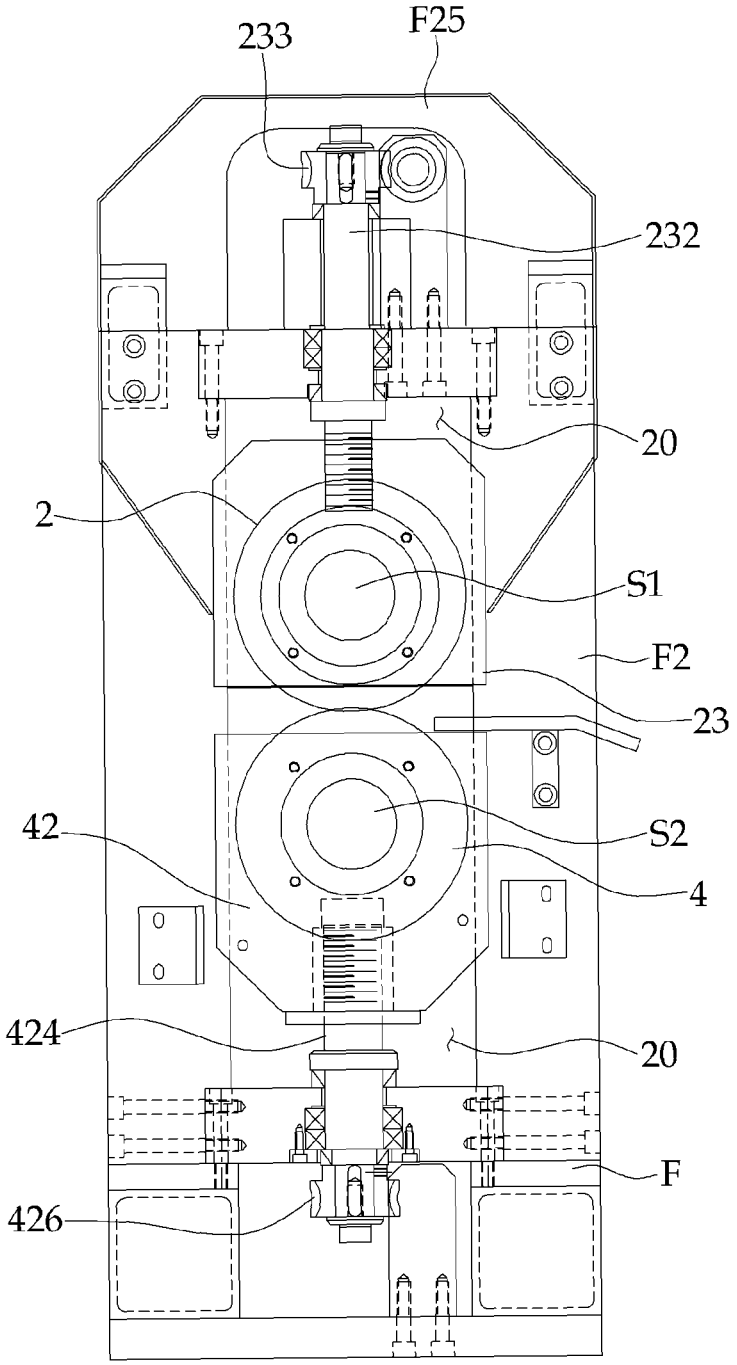
FIG. 3 is a detailed front view showing a coupling relation between upper and lower bead processing rolls according to the present invention.
Figure 4:
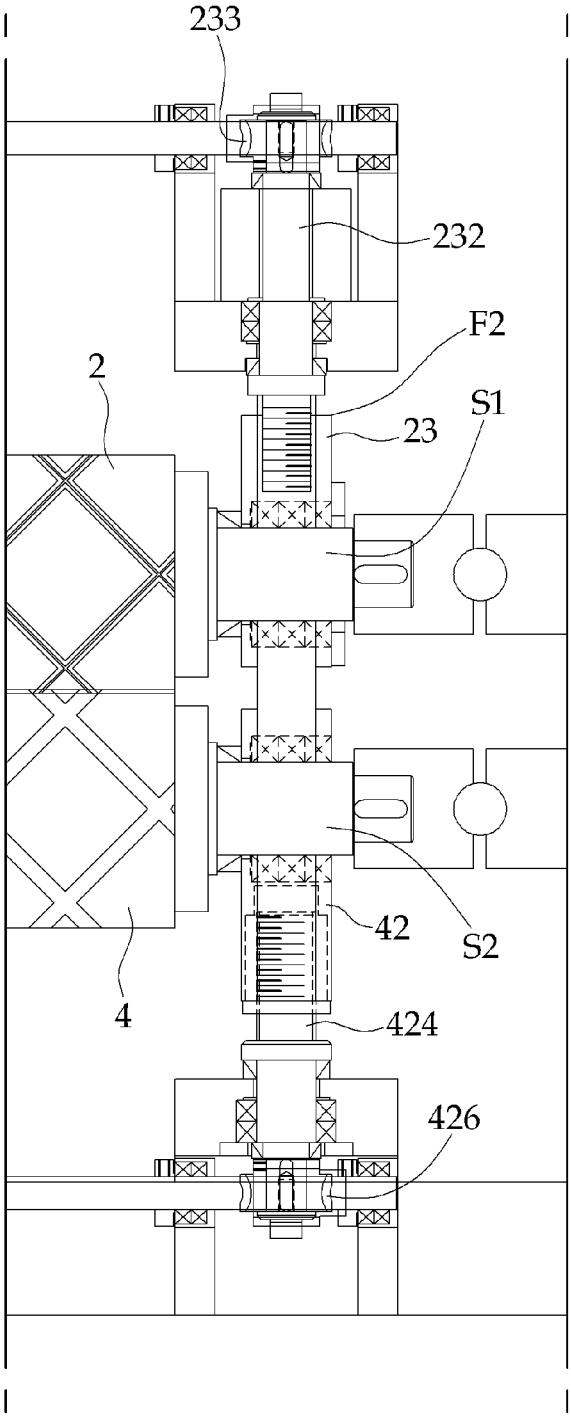
FIG. 4 is a detailed side view showing a coupling relation between upper and lower bead processing rolls according to the present invention.

FIG. 3 is a detailed front view showing a coupling relation between the upper and lower bead processing rolls according to the present invention and FIG. 4 is a detailed side view showing a coupling relation between the upper and lower bead processing rolls according to the present invention.

As shown in FIGS. 2 to 4, the upper and lower bead processing rolls 2 and 4 are formed on outer surfaces thereof with embossments or intaglios having shapes corresponding to shapes of the mesh-type beads. For instance, if the embossments are formed on the outer surface of the upper bead processing roll 2, the intaglios are formed on the outer surface of the lower bead processing roll 4.

The mesh-type beads are formed on the metal plate while the metal plate is passing through between the upper and lower bead processing rolls 2 and 4.

The upper and lower bead processing rolls 2 and 4 are provided at both ends thereof with the shafts S1 and S2 coupled with the roll chokes 23 and 42 inserted into the roll stands F2, and bearings are interposed between the shafts S1 and S2 and the roll chokes 23 and 42.

The first and second gears S1-1 and S2-2 are coupled to one ends of the shafts S1 and S2 and engaged with each other. In particular, as shown in FIG. 2, the pulley 76 is coupled to the shaft S2 of the lower bead processing roll 4 and connected to the driving unit 7 through the chain 74.

The chain 74 may be replaced with a belt or other connection units.

The roll stands F2 are erected on the frame F while being spaced apart from each other and formed at inner portions thereof with adjustment grooves 20 having rectangular shapes into which the roll chokes 23 and 42 are inserted.

The roll stands F2 are inserted into the adjustment grooves 20 such that the roll stands F2 can slidably move up and down. An upper end bar F25 is coupled to an upper end of the adjustment grooves 20.

Thus, the position of the roll chokes 23 and 42 coupled to the upper and lower bead processing rolls 2 and 4 can be adjusted within the adjustment grooves 20 and the roll chokes 23 and 42 can be fixed in the adjusted position, so that the interval between the upper and lower bead processing rolls 2 and 4 can be adjusted.

Hereinafter, the upper and lower bead processing rolls 2 and 4, the roll chokes 23 and 42, and the structure for moving up and down or fixing the upper and lower bead processing rolls 2 and 4, and the roll chokes 23 and 42 will be described in more detail.

The roll choke 23 of the upper bead processing roll 2 is a rectangular plate and guide holes (not shown) are formed at both side ends of the roll choke 23 such that the roll choke 23 can be coupled with the adjustment groove 20. An adjustment screw 232 is vertically coupled to the upper portion of the roll choke 23. The adjustment screw 232 is screw-coupled by passing through the upper end bar F25 and a handle 233 is screw-coupled with the upper portion of the adjustment screw 232.

Thus, if the handle 233 is rotated, the adjustment screw 232 is moved up so that the roll choke 23 is moved up. As a result, the upper bead processing roll 2 is moved up.

For instance, if the handle 233 is rotated in one direction, the adjustment screw 232 is moved up so that the roll choke 23 is moved up. In addition, if the handle 233 is rotated in the other direction, the adjustment screw 232 is moved down so that the roll choke 23 is moved down. Thus, the height of the upper bead processing roll 2 can be adjusted.

Meanwhile, the roll choke 42 of the lower bead processing roll 4 is a rectangular plate similar to the roll choke 23 of the upper bead processing roll 2 and guide holes (not shown) are formed at both side ends of the roll choke 42 such that the roll choke 42 can be coupled with the adjustment groove 20. An adjustment screw 424 is vertically coupled to the lower portion of the roll choke 42. The adjustment screw 424 is screw-coupled by passing through the top surface of the frame F and a handle 426 is screw-coupled with the lower portion of the adjustment screw 424.

Thus, if the handle 426 is rotated, the adjustment screw 424 is moved up so that the roll choke 42 of the lower bead processing roll 4 is moved up. As a result, the lower bead processing roll 4 is moved up.

For instance, if the handle 426 is rotated in one direction, the adjustment screw 424 is moved up so that the roll choke 42 is moved up. In addition, if the handle 426 is rotated in the other direction, the adjustment screw 424 is moved down so that the roll choke 42 is moved down. Thus, the height of the lower bead processing roll 4 can be adjusted.

Figure 5:
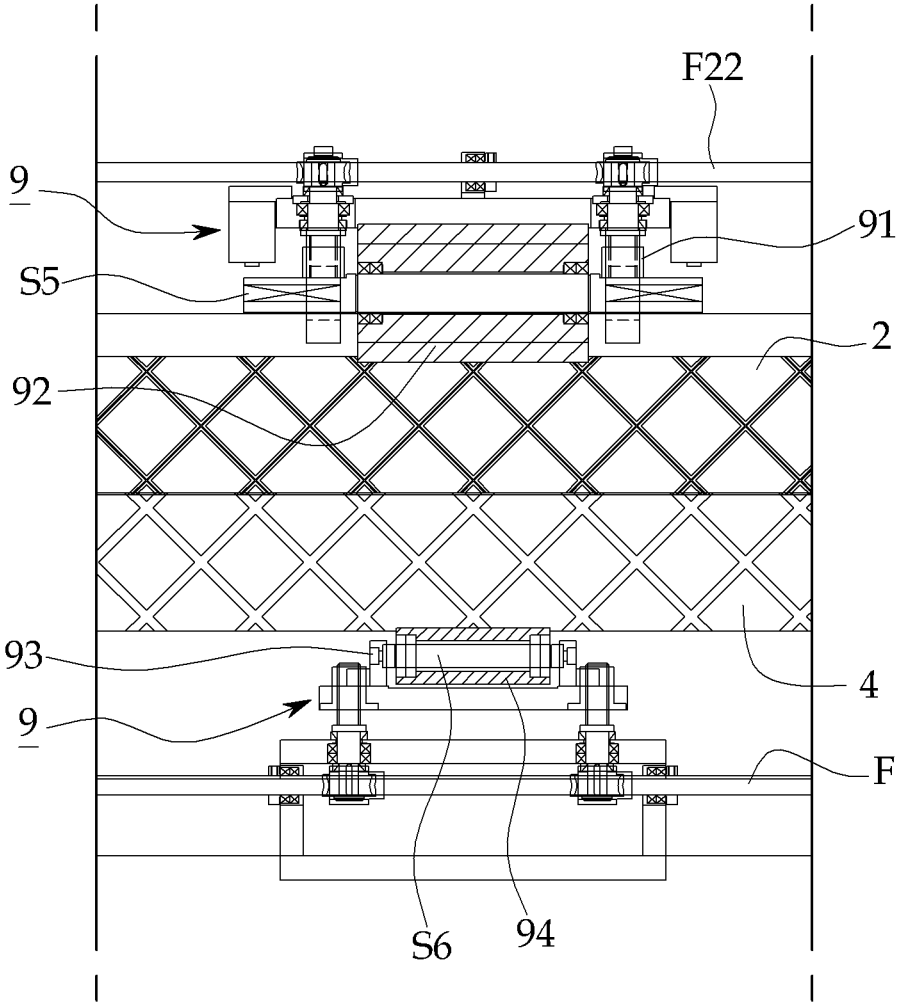
FIG. 5 is a detailed view showing an auxiliary roller device according to the present invention.

FIG. 5 is a detailed view showing the auxiliary roller device according to the present invention.

As shown in FIG. 5, the auxiliary roller device 9 is circumscribed to upper and lower portions of the upper and lower bead processing rolls 2 and 4 to prevent the upper and lower bead processing rolls 2 and 4 from being sagged.

The auxiliary roller device 9 includes a lower auxiliary roller 94 circumscribed to the lower bead processing roll 4 and an upper auxiliary roller 92 circumscribed to the upper bead processing roll 2.

In detail, the lower auxiliary roller 94 has a shaft S6 coupled to a plurality of brackets 93 vertically installed on the top surface of the frame F while being spaced apart from each other. The lower auxiliary roller 94 is circumscribed to the lower bead processing roll 4.

In addition, the upper auxiliary roller 92 has a shaft S5 coupled to a plurality of brackets 91 installed at a lower portion of a connection bar F22 connecting upper ends of the roll stands F2 with each other. The upper auxiliary roller 92 is circumscribed to the upper bead processing roll 2.

Figure 6:
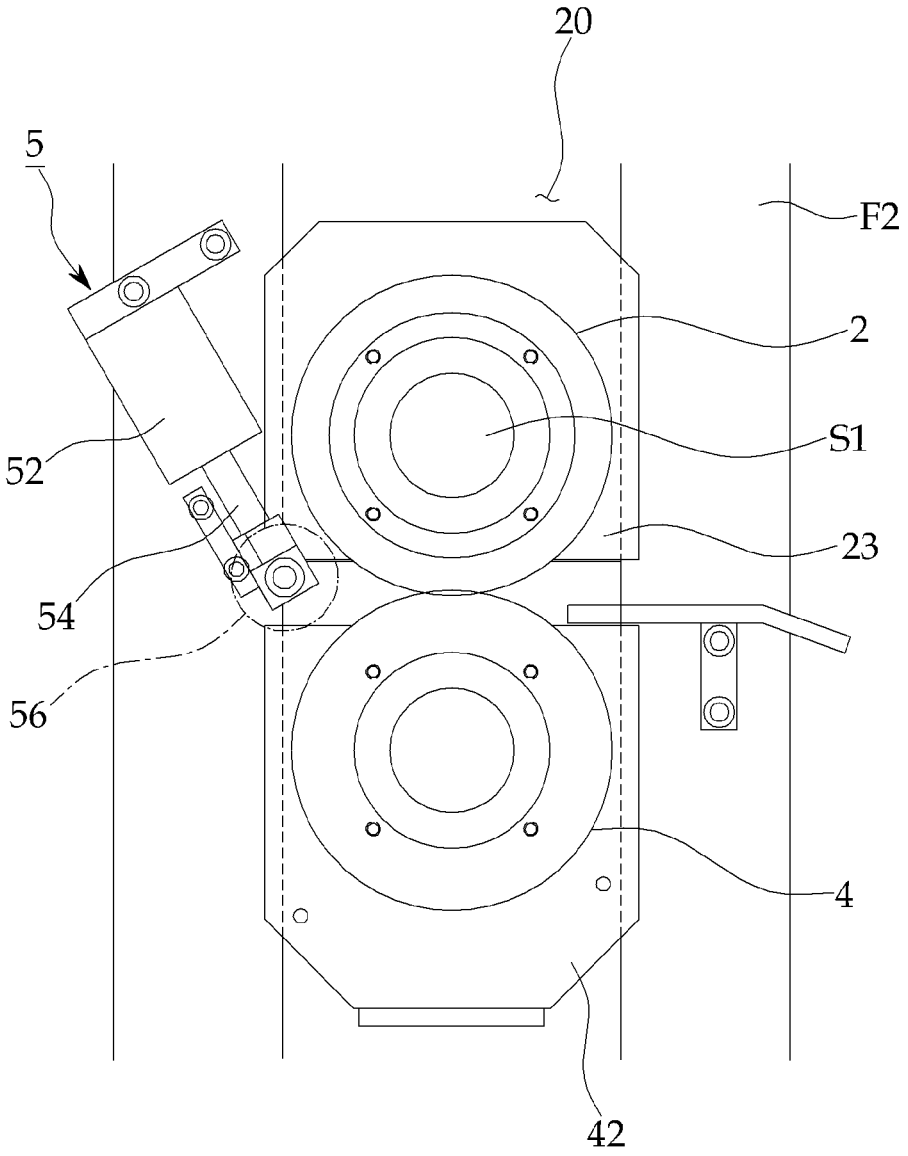
FIG. 6 is a detailed view showing a pressing roller device according to the present invention.

FIG. 6 is a detailed view showing the pressing roller device according to the present invention.

As shown in FIG. 6, the pressing roller device 5 is installed at fronts of the upper and lower bead processing rolls 2 and 4 to support the metal plate such that the metal plate, on which the beads are patterned while the metal plate is passing through between the upper and lower bead processing rolls 2 and 4, is prevented from being bent when the metal plate is drawn.

The pressing roller device 5 includes a cylinder body 52 installed on a mounting bar connecting front sides of both roll stands F2 with each other, a rod 54 inserted into the cylinder body 52 and a roller 56 coupled to the rod 54 and installed corresponding to a gap between the upper and lower bead processing rolls 2 and 4.

Figure 7:
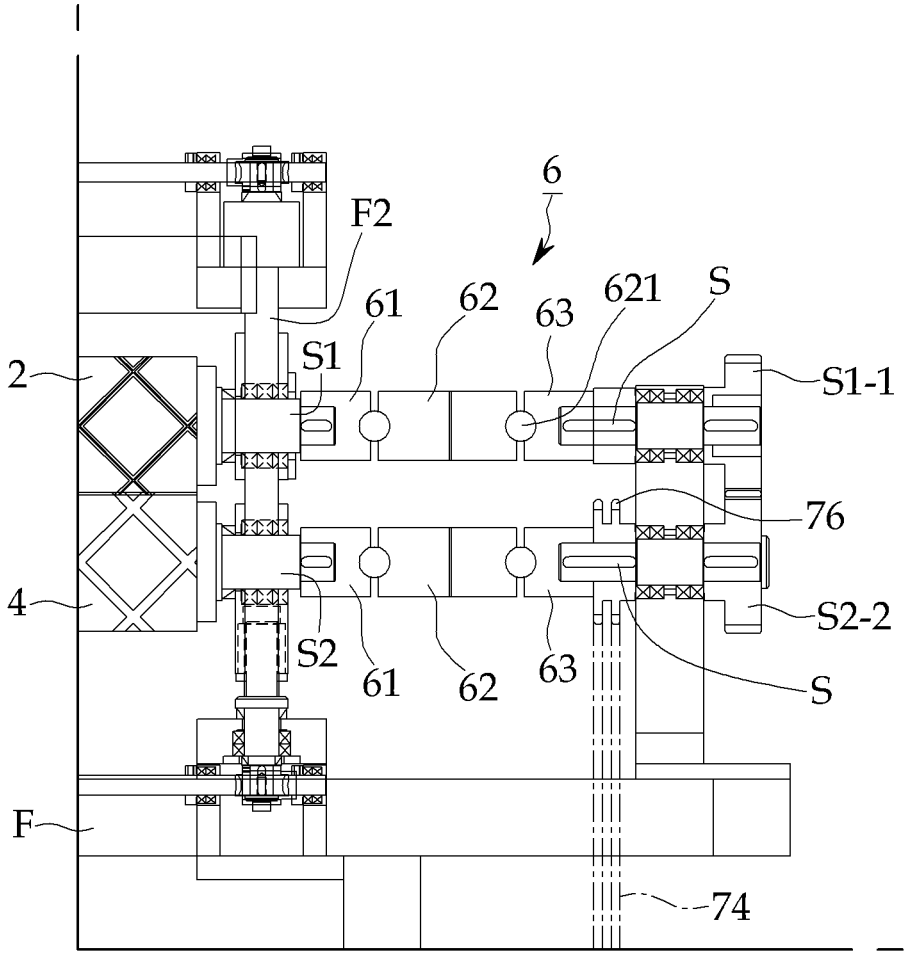
FIG. 7 is a detailed view showing an articulated connection part according to the present invention.
Figure 8:
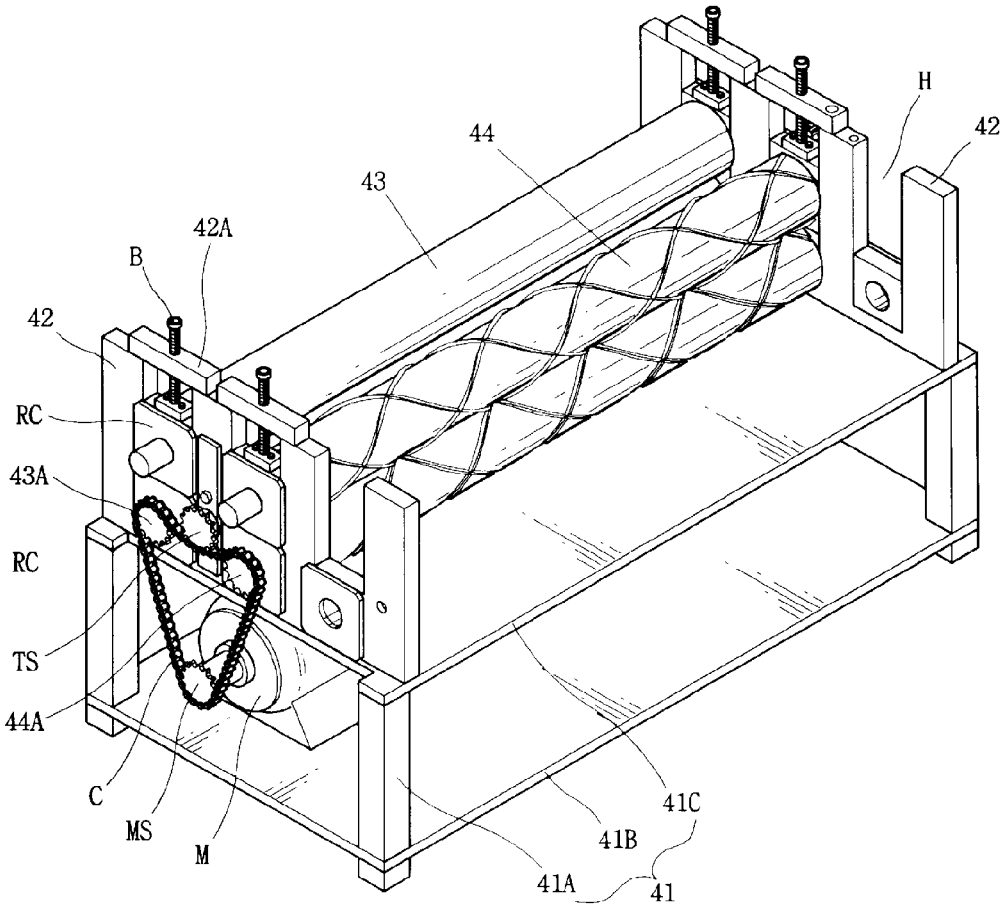
Fig. 8 PRIOR ART
FIG. 8 is a perspective view showing an apparatus for manufacturing a metal plate disclosed in Korean Registered Patent No. 0394557.

FIG. 7 is a detailed view showing the articulated connection part according to the present invention.

As shown in FIG. 7, the articulated connection part 6 is provided at the shafts S1 and S2 of the upper and lower bead processing rolls 2 and 4 and includes a plurality of articulated members connected with each other to adjust an interval between the upper and lower bead processing rolls 2 and 4 by moving the upper and lower bead processing rolls 2 and 4 up and down.

The articulated connection part 6 has the structure equal to the structure of a universal joint.

In detail, the articulated connection part 6 includes a first articulated member 61 having one end coupled to the shafts S1 and S2 of the upper and lower bead processing rolls 2 and 4, a second articulated member 62 rotatably coupled to an opposite end of the first articulated member 61, and a third articulated member 63 rotatably coupled to an opposite end of the second articulated member 62 and coupled to the shaft S of the first gear S1-1 or the second gear S2-2.

The first to third articulated members 61 to 63 are connected with each other through keys and coupled to the shafts of the first and second gears S1-1 and S2-2 through keys.

The key is a kind of a wedge inserted into key holes formed in a shaft and a rotating member to prevent the rotating member from being slid when the shaft is rotated. The key is generally known in the art, so detailed description thereof will be omitted.

Meanwhile, the first and third articulated members 61 and 63 are connected to balls 621 provided at both ends of the second articulated member 62 so that the first to third articulated members 61 to 63 can be tilted and rotated.

Therefore, if the interval between the upper and lower bead processing rolls 2 and 4 is adjusted by moving the roll chokes 23 and 42, the first to third articulated members 61 to 63 are tilted correspondingly.

For instance, if the upper bead processing roll 2 is moved up and the lower bead processing roll 4 is moved down, the interval between the upper and lower bead processing rolls 2 and 4 may be widened. Thus, the first to third articulated members 61 to 63 of the articulated connection part 6 connected to the upper bead processing roll 2 are tilted in one direction. In contrast, the first to third articulated members 61 to 63 of the articulated connection part 6 connected to the lower bead processing roll 4 are tilted in the other direction.

Even though the articulated connection part 6 is tilted, the tilting degree is very small, so the rotating force transferred to the pulley 76 of the second gear S2-2 can be transferred to the first gear S1-1, so that the upper and lower bead processing rolls 2 and 4 can be rotated.

The operational principle of the articulated connection part 6 is similar to that of the universal joint, so the person having the ordinary skill in the art may readily comprehend the operational principle of the articulated connection part 6.

Hereinafter, the operation of the present invention will be described.

If the driving unit 7 is driven by turning on a switch, idle rollers 110 of the feeding part 100 are rotated to prepare the conveyance of the metal plate.

Before the metal plate is supplied, the interval between the upper and lower bead processing rolls 2 and 4 is adjusted suitably for the thickness of the metal plate.

That is, the upper and lower bead processing rolls 2 and 4 are mutually moved up by rotating the handles 233 and 426 of the roll chokes 23 and 42 to adjust the interval between the upper and lower bead processing rolls 2 and 4. At this time, the pulley 76 coupled to the shaft S of the lower bead processing roll 4 is rotated by the driving unit 7, and the upper bead processing roll 2 becomes idle.

Thus, if the metal plate is introduced into the gap between the upper and lower bead processing rolls 2 and 4, the metal plate may move forward due to the rotation of the lower bead processing roll 4. While the metal plate moves through the upper and lower bead processing rolls 2 and 4, the bead patterns are formed on the outer surface of the metal plate.

The metal plate formed with the bead patterns may tend to be bent upward. However, since the metal plate is supported by the roller 56 of the pressing roller device 5, the metal plate can move linearly without being bent upward.

Meanwhile, according to the related art, the middle portions of the upper and lower bead processing rolls 2 and 4 may be sagged if the length of the upper and lower bead processing rolls 2 and 4 is increased. However, according to the present invention, the middle portions of the upper and lower bead processing rolls 2 and 4 are supported by the auxiliary roller device 9, so the upper and lower bead processing rolls 2 and 4 may linearly move. Thus, the life span of the apparatus may extend and factors causing the defect of the apparatus can be solved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An apparatus for manufacturing a metal plate having mesh-type shape beads for a duct, the apparatus comprising:

a frame constituted by connecting metal pieces in a form of a box;

roll stands vertically installed on a top surface of the frame while being spaced apart from each other by a predetermined interval;

upper and lower bead processing rolls provided at both ends thereof with shafts coupled to the roll stands and formed on outer surfaces thereof with embossments and intaglios having shapes corresponding to shapes of the mesh shape beads;

a feeding part including a plurality of idle rollers to stably feed metal plates from a rear of the upper and lower bead processing rolls;

first and second gears coupled to the shafts of the upper and lower bead processing rolls;

a pulley coupled to the second gear;

a driving unit including a driving motor connected to the pulley through a chain; and an auxiliary roller device circumscribed to upper and lower portions of the upper and lower bead processing rolls to prevent the upper and lower bead processing rolls from being sagged.

2. The apparatus of claim 1, wherein the shafts of the upper and lower bead processing rolls are rotatably coupled with roll chokes inserted into the roll stands, and the upper and lower bead processing rolls comprise:

the first and second gears coupled to one ends of the shafts and engaged with each other; and the pulley coupled to the shaft of the lower bead processing roll and connected to the driving unit.

3. The apparatus of claim 2, wherein the roll chokes of the upper and lower bead processing rolls comprise:

adjustment screws vertically coupled to upper and lower portions of the roll chokes; and handles installed to lower portions of the adjustment screws, and wherein the roll chokes are moved up and down in an adjustment groove according to an operation of the handles so that a position of the roll chokes is adjusted.

4. The apparatus of claim 1, wherein the auxiliary roller device comprises:

a lower auxiliary roller circumscribed to the lower bead processing roll; and an upper auxiliary roller circumscribed to the upper bead processing roll.

5. The apparatus of claim 1, further comprising a pressing roller device installed at fronts of the upper and lower bead processing rolls to support the metal plate such that the metal plate is prevented from being bent when the metal plate is drawn.

6. The apparatus of claim 5, wherein the pressing roller device comprises:

a cylinder body installed on a mounting bar connecting front sides of both roll stands with each other;

a rod inserted into the cylinder body; and a roller and installed corresponding to a gap between the upper and lower bead processing rolls.

7. The apparatus of claim 1, further comprising an articulated connection part provided at the shafts of the upper and lower bead processing rolls to adjust an interval between the upper and lower bead processing rolls.

8. The apparatus of claim 7, wherein the articulated connection part comprises:

a first articulated member having one end coupled to the shafts of the upper and lower bead processing rolls;

a second articulated member rotatably coupled to an opposite end of the first articulated member; and a third articulated member rotatably coupled to an opposite end of the second articulated member of the first gear or the second gear, and wherein the first and third articulated members are connected to balls provided at both ends of the second articulated member so that the first to third articulated members are tilted and rotated.

* * * * *